US010081213B2

(12) United States Patent
Fuhse

(10) Patent No.: US 10,081,213 B2
(45) Date of Patent: Sep. 25, 2018

(54) OPTICALLY VARIABLE SECURITY ELEMENT

(71) Applicant: GIESECKE+DEVRIENT CURRENCY TECHNOLOGY GMBH, München (DE)

(72) Inventor: Christian Fuhse, Otterfing (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 15/571,993

(22) PCT Filed: May 4, 2016

(86) PCT No.: PCT/EP2016/000733
§ 371 (c)(1),
(2) Date: Nov. 6, 2017

(87) PCT Pub. No.: WO2016/177470
PCT Pub. Date: Nov. 10, 2016

(65) Prior Publication Data

US 2018/0117949 A1 May 3, 2018

(30) Foreign Application Priority Data

May 7, 2015 (DE) ..... 10 2015 005 911

(51) Int. Cl.
*B42D 25/00* (2014.01)
*B42D 25/324* (2014.01)
(Continued)

(52) U.S. Cl.
CPC ..... *B42D 25/342* (2014.10); *B42D 25/00* (2014.10); *B42D 25/21* (2014.10); *B42D 25/23* (2014.10);
(Continued)

(58) Field of Classification Search
CPC ..... B42D 25/324; B42D 25/328
See application file for complete search history.

(56) References Cited

U.S. PATENT DOCUMENTS 7,002,746 B2 2/2006 Schilling et al.
7,604,855 B2 * 10/2009 Raksha ..... B42D 25/00 283/72
(Continued)

FOREIGN PATENT DOCUMENTS

DE 10216561 A1 10/2003
DE 102010047250 A1 6/2011
(Continued)

OTHER PUBLICATIONS

German Search Report from DE Application No. 10 2015 005 911.4, dated Apr. 4, 2016.
(Continued)

*Primary Examiner* — Kyle R Grabowski
(74) *Attorney, Agent, or Firm* — Workman Nydegger

(57) ABSTRACT

An optically variable security element for securing valuable articles that viewing-angle-dependently displays a motif having at least one curve depiction that, from a first viewing direction, is visible as an initial curve having two or more connected, non-collinear segments and that, when the security element is tilted about a predetermined axis, splits into the individual segments in that the segments of the initial curve move alternatingly in different directions away from the initial curve. Each of the segments has associated with it one movement segment in the form of a sub-region of an areal motif region, such that, from the first viewing direction, the segments display the initial curve having the connected segments and that, from viewing directions tilted about the predetermined axis, they display curve depictions in which, with increasing tilt angle, the segments lie alter-
(Continued)

natingly in different directions increasingly further away from the initial curve.

20 Claims, 4 Drawing Sheets

(51) Int. Cl.

| | |
|---|---|
| ***B42D 25/328*** | (2014.01) |
| ***B42D 25/342*** | (2014.01) |
| ***B42D 25/29*** | (2014.01) |
| ***B42D 25/21*** | (2014.01) |
| ***B42D 25/23*** | (2014.01) |
| ***B42D 25/40*** | (2014.01) |

(52) U.S. Cl.
CPC ..... *B42D 25/29* (2014.10); *B42D 25/324* (2014.10); *B42D 25/328* (2014.10); *B42D 25/40* (2014.10)

(56) References Cited

U.S. PATENT DOCUMENTS

| | | | | |
|---|---|---|---|---|
| 9,176,266 | B2 | 11/2015 | Fuhse et al. | |
| 9,676,156 | B2 | 6/2017 | Tompkin et al. | |
| 2005/0163922 | A1 | 7/2005 | Schilling et al. | |
| 2006/0194040 | A1* | 8/2006 | Raksha | B05D 3/207 428/323 |
| 2006/0198998 | A1* | 9/2006 | Raksha | B42D 25/29 428/323 |
| 2012/0205905 | A1* | 8/2012 | Degott | B42D 25/40 283/72 |
| 2012/0319395 | A1 | 12/2012 | Fuhse et al. | |
| 2014/0037898 | A1 | 2/2014 | Tompkin et al. | |
| 2014/0160568 | A1* | 6/2014 | Fuhse | B42D 25/00 359/586 |
| 2015/0352884 | A1 | 12/2015 | Fuhse et al. | |
| 2016/0023495 | A1* | 1/2016 | Fuhse | B42D 25/328 359/566 |
| 2016/0325578 | A1* | 11/2016 | Ritter | B42D 25/324 |
| 2017/0021660 | A1* | 1/2017 | Petiton | B42D 25/324 |
| 2017/0239898 | A1 | 8/2017 | Tompkin et al. | |

FOREIGN PATENT DOCUMENTS

| | | | |
|---|---|---|---|
| DE | 102011014114 | B3 | 5/2012 |
| EP | 1710756 | A1 | 10/2006 |
| EP | 3000613 | A1 | 3/2016 |
| WO | 2011051669 | A1 | 5/2011 |
| WO | 2014117938 | A1 | 8/2014 |

OTHER PUBLICATIONS

International Preliminary Report on Patentability from PCT Application No. PCT/EP2016/000733, dated Nov. 7, 2017.
International Search Report from PCT Application No. PCT/EP2016/000733, dated Aug. 2, 2016.

* cited by examiner

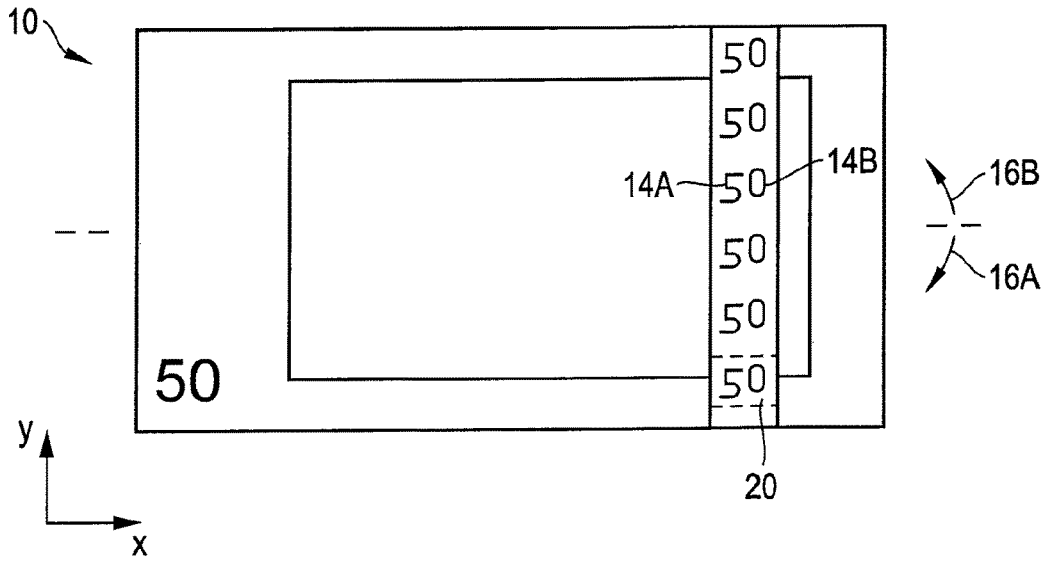
Fig. 1
Fig. 2(a)
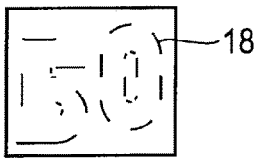
Fig. 2(b)
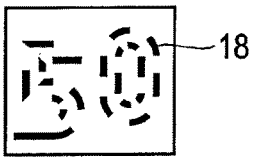
Fig. 2(c)
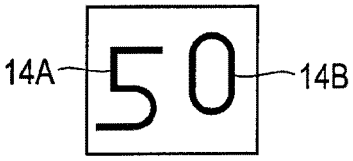
Fig. 2(d)
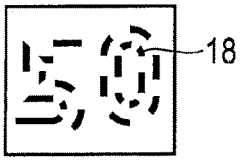
Fig. 2(e)
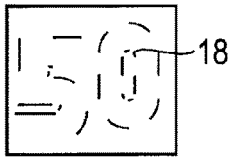

Fig. 9(a) Fig. 9(b) Fig. 9(c) Fig. 9(d) Fig. 9(e)
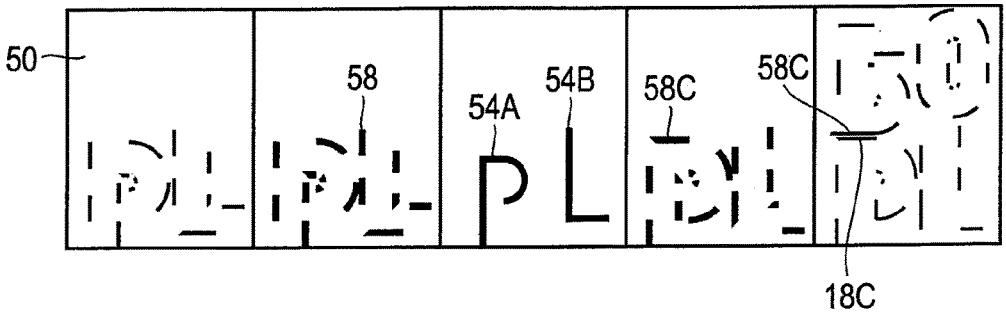
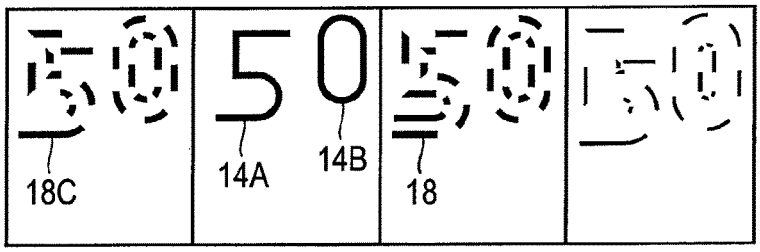
Fig. 9(f) Fig. 9(g) Fig. 9(h) Fig. 9(i)
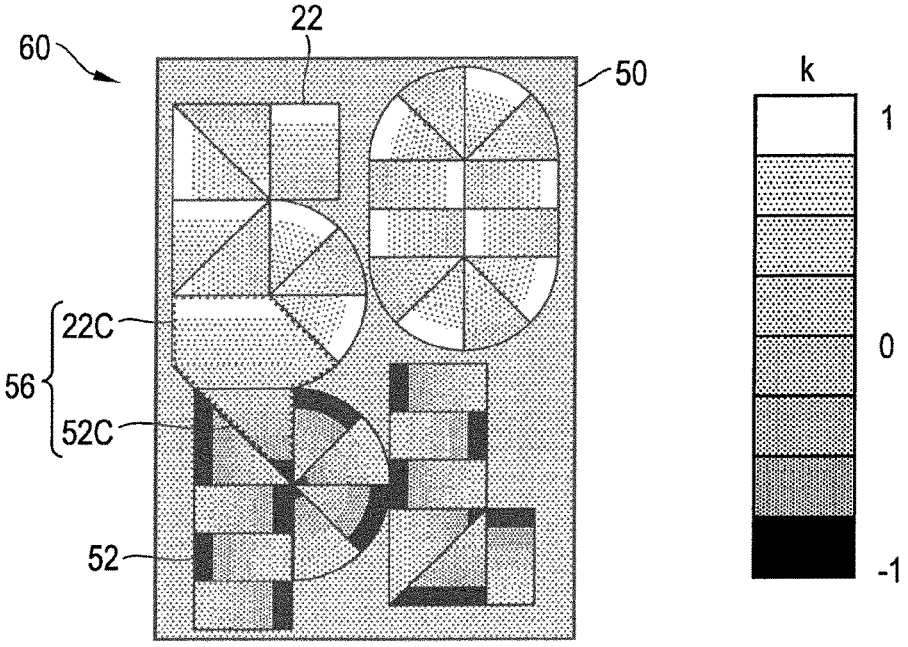
Fig. 10

OPTICALLY VARIABLE SECURITY ELEMENT

BACKGROUND

The present invention relates to an optically variable security element for securing valuable articles, a method for manufacturing such a security element and a data carrier that is equipped accordingly.

For protection, data carriers, such as value or identification documents, or other valuable articles, such as branded articles, are often provided with security elements that permit the authenticity of the data carriers to be verified, and that simultaneously serve as protection against unauthorized reproduction. Security elements having viewing-angle-dependent effects play a special role in safeguarding authenticity, as these cannot be reproduced even with the most modern copiers. Here, the security elements are furnished with optically variable elements that, from different viewing angles, convey to the viewer a different image impression and, depending on the viewing angle, display for example another color or brightness impression and/or another graphic motif.

In this context, optically variable security elements are known that display different movement or tilt effects when the security element is tilted, such as moving bars, moving pictorial depictions, pump effects or three-dimensional depictions. To implement the optically variable appearances, in the background art, different techniques are used that typically permit some of said movement effects to be realized particularly well and others less well.

For example, with moire magnification arrangements based on microfocusing elements and microimages, particularly moving periodic motifs can be depicted well. In contrast, tilt images or depictions having an excellent center position, that is, a view that at the same viewing angle always looks the same in all security elements produced, are often difficult to realize due to the required high-accuracy registration of the microfocusing elements and microimages.

Through nested depictions that become visible at different tilt angles, holograms can, in principle, display arbitrary animations, but the quality and luminosity of the depictions are strongly dependent on good lighting. This applies similarly to security elements having micromirror arrangements if the different views of an animation are to be nested, even if micromirror arrangements are normally brighter than holograms.

In optically variable security features based on printing inks having magnetically aligned reflective pigments, the produced effects are very bright, but to realize a certain movement effect, corresponding magnets are also always needed to align the pigments, which in practice severely limits the variety of effects and the resolution.

The optically variable effects mentioned are often difficult to individualize, that is, for example, to adjust to a certain currency or a certain value numeral. A widespread possibility for individualization consists in a demetalization in some regions, in which an effect layer is omitted in some regions, for instance in the form of a value numeral. However, such inverse texts are comparatively inconspicuous, increasing the risk that a counterfeiter uses, for example, an authentic security element from a banknote having a low value to counterfeit a banknote having a higher value without it attracting the attention of the untrained or cursory viewer.

SUMMARY

Proceeding from this, it is the object of the present invention to specify a security element of the kind cited above that displays a novel optically variable effect that clearly stands out from conventional effects. Ideally, the optically variable effect also enables a conspicuous and easily memorable individualization of the security element or of the data carrier provided therewith.

Said object is solved by the features of the independent claims. Developments of the present invention are the subject of the dependent claims.

According to the present invention, a generic security element viewing-angle-dependently displays a motif having at least one curve depiction that, from a first viewing direction, is visible as an initial curve having two or more connected, non-collinear segments, and that, when the security element is tilted about a predetermined axis, splits into the individual segments in that the segments of the initial curve move alternatingly in different directions away from the initial curve.

Here, according to the present invention, the security element comprises an areal motif region having a plurality of optically effective elements, each of which directs incident light in a preferred direction, the segments of the initial curve in the areal motif region each having associated with it one movement segment in the form of a sub-region of the areal motif region, in which sub-region the optically effective elements are arranged and aligned in such a way that, from the first viewing direction, they display the initial curve having the connected segments and that, from viewing directions tilted about the predetermined axis, they display curve depictions in which, with increasing tilt angle, the segments lie alternatingly in different directions increasingly further away from the initial curve.

The connected segments of the initial curve are non-collinear, that is, they do not all lie on a straight line. Thus, at least two of the connected segments of the initial curve do not lie on a straight line. This also does not preclude spaced-apart segments being parallel to each other, for instance like the two congruent lines joined by the diagonal of the letter "Z".

Preferably, at least one curve depiction of the motif splits into three or more, preferably four or more, or even six or more segments when the security element is tilted. Since the segments move alternatingly in different directions away from the initial curve when the security element is tilted, the moving segments are no longer connected but are initially still adjacent, such that the visual impression of a curve splitting into the individual segments is created.

The initial curve of at least one curve depiction advantageously displays an alphanumeric character, a symbol, such as the euro symbol or another currency symbol, or another information-bearing character. In particular, also two or more initial curves can be provided that together form a number, such as value numeral of a banknote, a letter string or a symbol string.

The movement segments of the curve depictions advantageously have a width that is between 10% and 100%, preferably between 20% and 50% of the dimension of the initial curve of the curve depiction. Here, the dimension of the movement segments perpendicular to the associated segment of the initial curve is designated as the width of the movement segments. Within a curve depiction, the movement segments advantageously all have the same width.

The optically effective elements direct incident light in each case in a preferred direction, the mechanism of the light deflection depending on the type of the optically effective elements. For example, the optically effective elements can be reflective facets that form small micromirrors that direct incident light in a preferred direction given by the condition "angle of incidence equals angle of reflection." In addition to reflection, especially also refraction, for example by lens elements or prism elements, or light diffraction, for example by hologram grating regions, may be used. The light deflection by the optically effective elements can occur in reflection, in transmission or both in reflection and in transmission.

In one advantageous variant of the present invention, the optically effective elements are formed by ray-optically effective facets whose orientation in each case is characterized by an inclination angle $\alpha$ against the plane of the areal motif region and by an azimuth angle $\theta$ in the plane of the areal motif region. Here, the dimension of the facets is preferably so large that no or hardly any diffractions effects occur, such that the facets act substantially only ray optically. In particular, the facets advantageously have a smallest dimension of more than 2 μm, preferably of more than 5 μm, especially of more than 10 μm. In particular, for use in banknotes and other value documents, the facets preferably have a height below 100 μm, preferably below 50 μm, especially of less than 10 μm. The facets can be arranged regularly, for example in the form of a 1- or 2-dimensional periodic grid, for instance of a sawtooth grating, or also aperiodically.

The optically effective elements can also advantageously be formed by diffraction-optically effective grating fields having a grating pattern composed of parallel grating lines. Here, the preferred direction of the light deflection is given by the grating parameters of the grating pattern, especially by the grating period p and the azimuth angle $\varphi$, which specifies the angle that the grating lines of the grating pattern include with a reference direction.

In a further advantageous variant of the present invention, the optically effective elements are formed by groove- and/or rib-shaped structural elements that lie adjacent to one another and extend along a longitudinal direction, as are explained in greater detail in, for example, document WO 2014/117938 A1, whose disclosure is incorporated in the present application by reference.

The areal motif region can be developed to be reflective such that the initial curve and the split of the initial curve into individual segments are visible in reflection.

In advantageous embodiments, the optically effective elements are formed by reflection elements that are cast in an embossing lacquer and provided with a reflection-increasing coating. The reflection-increasing coating can be formed by a metalization and/or can have a color-shift effect, in which case the coating advantageously consists of a thin-film interference layer system having a reflector, a dielectric spacing layer and an absorber.

The areal motif region can also be at least partially transmissive such that the initial curve and the split of the initial curve into individual segments are visible in transmission. Here, the areal motif region can also be developed to be both partially reflective and partially transmissive, such that the initial curve and the split of the initial curve into individual segments are visible both in reflection and in transmission.

In advantageous embodiments, the optically effective elements are formed by transmission elements in the form of transparent or semitransparent diffraction patterns, transparent or semitransparent prism patterns or transparent or semitransparent microrelief patterns. As already mentioned above, the transmission elements can, at the same time, have reflective properties and thus produce an additional movement effect in reflection.

In one advantageous development of the present invention, it is provided that the motif of the security element includes at least a second curve depiction that, from a second viewing direction, is visible as a second initial curve having two or more connected, non-collinear segments, and that, when the security element is tilted about the predetermined axis, splits into the individual segments in that the segments of the second initial curve move alternatingly in different directions away from the second initial curve, the segments of the second initial curve in the areal motif region each having associated with it one second movement segment in the form of a subregion of the areal motif region, in which sub-region the optically effective elements are arranged and aligned in such a way that, from the second viewing direction, they display the second initial curve having the connected segments, and that, from viewing directions tilted about the predetermined axis, they display curve depictions in which, with increasing tilt angle, the segments lie alternatingly in different directions increasingly further away from the second initial curve.

In one advantageous variant of the present invention, the movement segments of the first and second curve depiction do not overlap here.

To achieve a large visual separation of the two curve depictions when viewed, the first and second viewing direction advantageously include an angle of at least 5°, preferably at least 10° and particularly preferably at least 20°.

In one advantageous variant of the present invention, at least one segment of the first curve depiction is also a segment of the second curve depiction such that, when the security element is tilted, the second curve depiction is at least partially composed of segments of the split first curve depiction.

It is understood that, in the same way, the motif of the security element can also include more than two curve depictions that, from different viewing directions, are visible as connected initial curves.

The security element advantageously constitutes a security thread, a tear strip, a security band, a security strip, a patch or a label for application to a security paper, value document or the like.

The present invention also includes a data carrier having a security element of the kind described, it being possible to arrange the security element both in an opaque region of the data carrier and in or over a transparent window region or a through opening in the data carrier. The data carrier can especially be a value document, such as a banknote, especially a paper banknote, a polymer banknote or a foil composite banknote, a stock, a bond, a certificate, a voucher, a check, a valuable admission ticket, but also an identification card, such as a credit card, a bank card, a cash card, an authorization card, a personal identity card or a passport personalization page.

BRIEF DESCRIPTION OF THE DRAWINGS

The present invention further includes a method for manufacturing an optically variable security element of the kind described above, in which

- a desired initial curve having two or more connected, non-collinear segments is defined,
- for each of the segments of the initial curve, movement segments are defined in which the segments of the initial curve move when the security element is tilted, and
- in an areal motif region in the defined movement segments, optically effective elements are arranged and aligned in such a way that, from the first viewing direction, they display the initial curve having the connected segments and that, from viewing directions tilted about the predetermined axis, they display curve depictions in which, with increasing tilt angle, the segments lie alternatingly in different directions increasingly further away from the initial curve.

Further exemplary embodiments and advantages of the present invention are explained below by reference to the drawings, in which a depiction to scale and proportion was dispensed with in order to improve their clarity.

Figure 3:
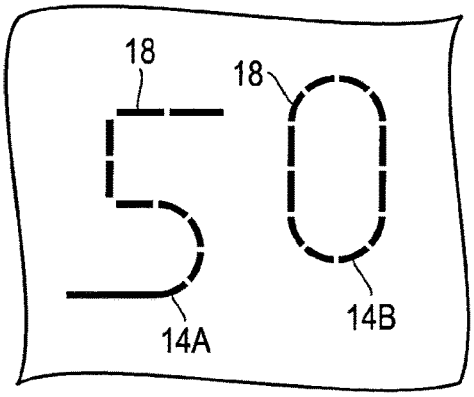
Figure 4:
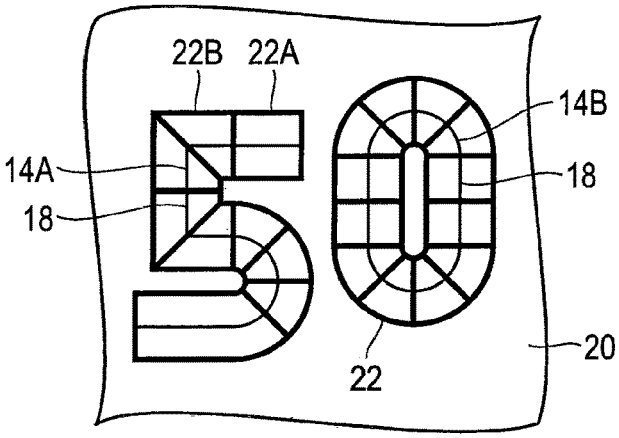
Figure 5:
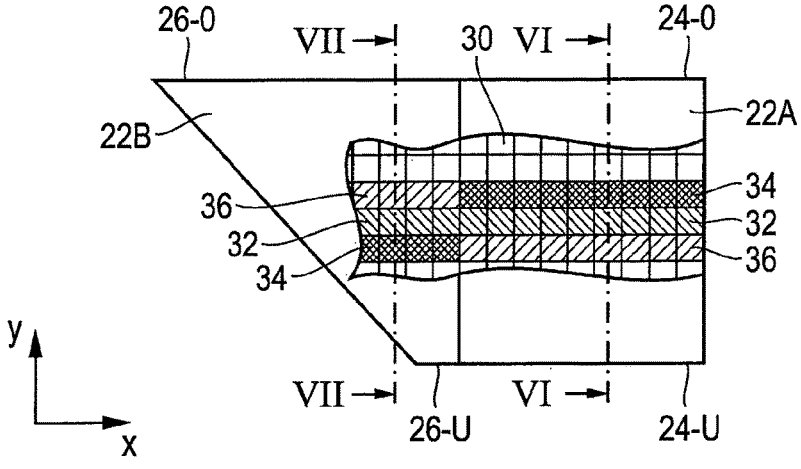
Figure 6:
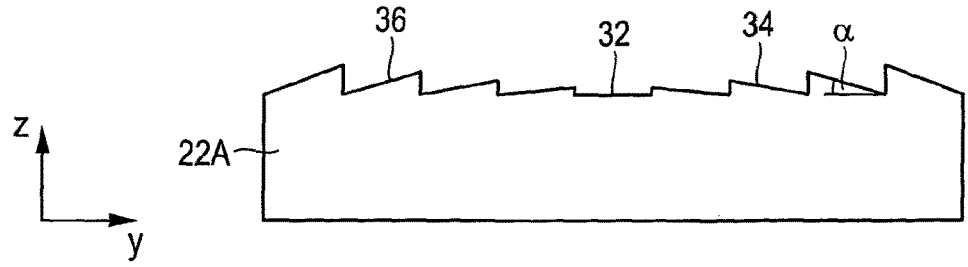
Figure 7:
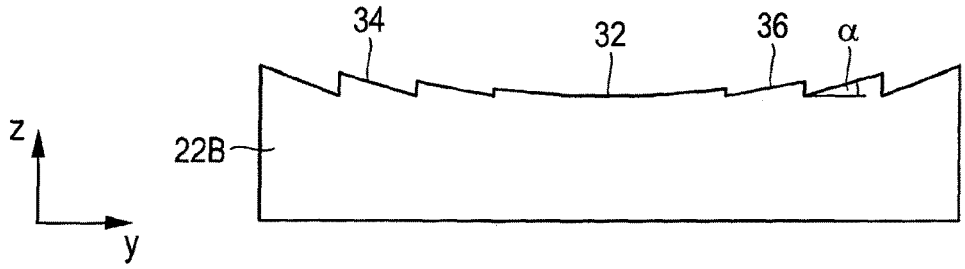
Figure 8:
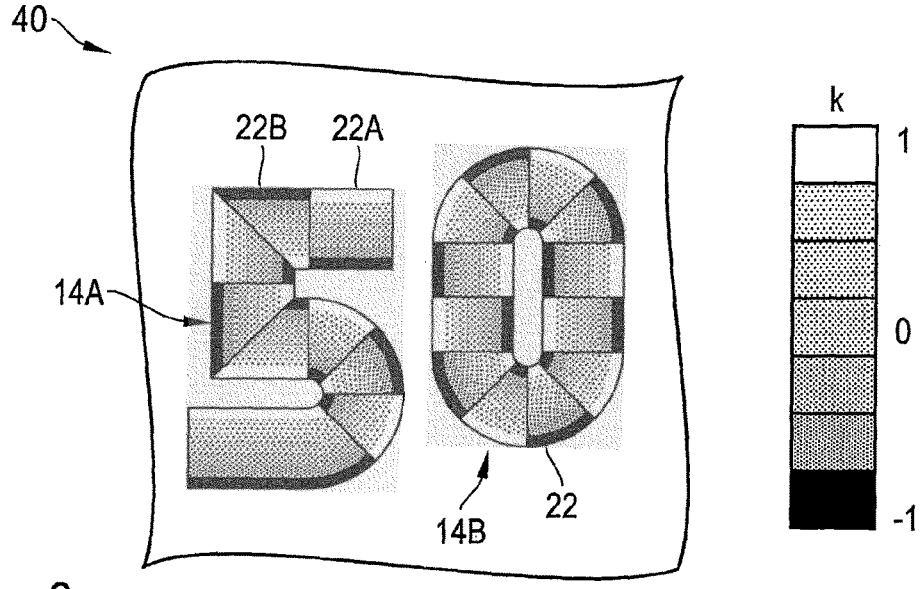

Shown are:

FIG. 1 a schematic diagram of a banknote having an optically variable security element according to the present invention, FIGS. 2(*a*)-2(*e*) the appearance of the optically variable security element in FIG. 1 at different tilt angles between −20° and +20°, FIG. 3 the curve depictions of the numbers "5" and "0" of the value numeral "50" in FIG. 1 having, for illustration, segments that are separated from one another, FIG. 4 a schematic top view of an areal motif region that shows, as a section of the security element in FIG. 1, a depiction of the value numeral "50", FIG. 5 schematically, two of the movement segments of the number "5" in FIG. 4, in detail, FIGS. 6 and 7 in each case, a schematic cross section through the areal motif region in FIGS. 4 and 5, respectively, along the lines VI-VI and VII-VII, respectively, FIG. 8 the values of the orientation parameter k for the exemplary embodiment of the splitting value numeral "50", in a grayscale depiction, FIGS. 9(*a*)-9(*i*) the visual appearance of a security element according to a further exemplary embodiment of the present invention, at different tilt angles, and FIG. 10 the values of the orientation parameter k for the exemplary embodiment in FIG. 9, in grayscale depiction.

DETAILED DESCRIPTION OF VARIOUS EMBODIMENTS

The invention will now be explained using the example of security elements for banknotes. For this, FIG. 1 shows a schematic diagram of a banknote 10 having an inventive optically variable security element 12 in the form of a wide security strip applied to the banknote substrate. It is understood that the present invention is not limited to security strips and banknotes, but rather can be used in all kinds of security elements, for example in labels on goods and packaging, or in safeguarding documents, identity cards, passports, credit cards, health cards and the like. In banknotes and similar documents, besides security strips, also security threads or transfer elements, for example, may be used.

The security strip 12 has a metallic appearance and, when viewed perpendicularly from above, displays the value numeral "50" multiply spaced apart one on top of another. Each depiction of the value numeral "50" consists of two curve depictions 14A, 14B that are each formed by connected polylines "5" and "0", respectively. The curve depictions 14A, 14B, when viewed perpendicularly from above, are perceptible as light polylines against the somewhat darker, but likewise metallically gleaming background of the security strip 12. Said visual impression when viewed perpendicularly from above is depicted again in greater detail in FIG. 2(*c*).

When the banknote 10 is tilted 16A, 16B about its longitudinal axis, the security strip 12 displays a striking optical effect: The originally connected curve depictions 14A, 14B, frequently also referred to below as initial curves, split for the viewer into a plurality of individual segments 18 that, with increasing tilt, move alternatingly in different directions away from the respective initial curve.

For illustration, FIGS. 2(*a*) and (*b*) show the appearance of the security element 12 when tilted 20° and 10° downward (tilt direction 16A), respectively, while FIGS. 2(*d*) and (*e*) show the visual appearance when tilted 20° and 10° upward (tilt direction 16B), respectively. In total, FIG. 2 shows, by way of example, five tilt positions having different visual impressions. In practice, security elements according to the present invention often include considerably more, for example 6 to 20, tilt positions having different visual impressions.

Proceeding from the connected depiction of the initial curves 14A, 14B in FIG. 2(*c*), when the banknote 10 is tilted, there appears for a viewer a more or less continuous-seeming "splitting" of the initial curves "5" and 0" into individual line segments, in which the initially connected segments come apart and then increasingly move away from each other, until a substantially unordered appearance is created in which the original initial curves are not or are hardly perceptible any longer (FIG. 2(*a*) or 2(*e*)). When tilted back, the initial curves 14A, 14B reassemble themselves from the individual segments to form the value numeral "50", to then split again into individual segments when tilted further in the other tilt direction.

The occurrence of this striking splitting effect will now be explained in greater detail with reference to FIGS. 3 to 7, with FIG. 3 showing the curve depictions 14A, 14B in the value numeral "50" having, for illustration, segments 18 that are somewhat separated from one another, FIG. 4 being a schematic top view of an areal motif region 20 that forms a section of the security element 12 in FIG. 1, FIG. 5 depicting two of the movement segments in FIG. 4 in detail, and FIGS. 6 and 7 each showing a cross section through the areal motif region in FIGS. 4 and 5, respectively, along the lines VI-VI and VII-VII, respectively, in FIG. 5.

As is clearly visible in the curve depictions 14A, 14B in FIG. 3, each of the two initial curves in the form of the numbers "5" and "0" consists of multiple connected, non-collinear segments 18. Each of said segments 18 has associated with it, within the areal motif region 20, a sub-region 22 in which the segment 18 appears to move when the security element 12 is tilted and that is thus referred to below as a movement segment 22.

The movement segments 22 extend perpendicularly substantially the same distance from the initial curve on both sides, the width of the segments advantageously being between 20% and 50% of the dimension of the initial curve. FIG. 4 shows, besides said movement segments 22, also each of the initial curves 14A and 14B whose connected segments lie in each case, in the exemplary embodiment, in the middle of the movement segments 22.

As shown in the detailed section in FIG. 5 and the cross sections in FIGS. 6 and 7, the areal motif region 20 includes a plurality of optically effective elements in the form of reflective facets 30 that, in the exemplary embodiment, have a base area of 15 μm×15 μm and a maximum height of about 5 μm. As is best perceptible in FIGS. 6 and 7, the facets 30 in the y-direction, that is, along the tilt directions 16A, 16B, are inclined by different angles, and reflect incident light in a preferred direction that for each facet 30 is given by the condition "angle of incidence equals angle of reflection".

Here, the facets 32 each arranged in the middle of the movement segments 22A and 22B have an inclination angle $\alpha=0°$ against the plane of the areal motif region 20 and therefore, when light incidence is perpendicular, reflect substantially perpendicularly upward. The facets 34 in the movement segment 22A that are offset in the +y-direction from the facets 32 have increasing inclination angles $\alpha$ up to an inclination angle $\alpha=+20°$ at the upper edge 24-O of the movement segment, while the facets 36 that are offset in the −y-direction have decreasing inclination angles $\alpha$ up to an inclination angle $\alpha=-20°$ at the lower edge 24-U of the movement segment.

In the immediately adjacent movement segment 22B, the inclination angles of the facets change inversely, that is, starting from the facets arranged in the middle having a tilt angle $\alpha=0°$, the facets 36 that are offset in the +y-direction have a decreasing inclination angle $\alpha$ up to an inclination angle $\alpha=-20°$ at the upper edge 26-O of the movement segment 22B, while the facets 34 that are offset in the −y-direction have an increasing inclination angle $\alpha$ up to an inclination angle $\alpha=+20°$ at the lower edge 26-U of the movement segment 22B.

If the security element 12 having the surface region 20, starting from perpendicular top view, is now tilted a few degrees downward (tilt direction 16A), then the reflection condition "angle of incidence equals angle of reflection" is fulfilled in the movement segment 22A for facets 34 that are offset upward (in the +y-direction), and in the movement segment 22B for facets 34 that are offset downward (in the −y-direction). The reverse applies for a tilt a few degrees upward in tilt direction 16B. The segments 18 that are visible in the movement segments 22A, 22B of the curve depiction 14A thus proceed for the viewer, upon tilting in the opposite direction, away from the initial curves and move away from each other.

The furnishing with optically variable elements described by way of example for the movement segments 22A, 22B is carried out accordingly also for the other movement segments 22 of the surface region 20, such that the inclination angles of the facets 30 each change inversely in adjacent movement segments. In this way, the segments 18 of the initial curves 14A, 14B each proceed for the viewer alternatingly in different directions along the initial curves such that the initial curves appear to split when the security element is tilted.

In the exemplary embodiment in FIGS. 4 to 7, the visual divergence of the segments 18 is realized by way of example by inclination angles of reflective facets 30, which inclination angles increase in different directions. Since, instead of reflective facets, also other optically effective elements can be used, the divergence of the curve segments is advantageously generally described by an orientation parameter k that, by definition, is between −1 and +1. The position of the connected segments in the initial curve typically corresponds to the value k=0, while the extreme values k=±1 are assumed for each segment 18 at the opposing edges of the movement segment 22. By using a general orientation parameter k, the shape of the movement segments and the movement behavior of the segments when tilted can be described independently of the specific realization of the optically effective elements.

For illustration, FIG. 8 shows the values of the orientation parameter k for the exemplary embodiment of the splitting value numeral "50" in a grayscale depiction 40, in which the white gray level corresponds to the value k=+1 and the black gray level to the value k=−1. As is perceptible in FIG. 8, the individual segments 18 of the curve depictions 14A, 14B at k=0, depicted by a medium gray, are connected and form the numbers "5" and "0", respectively. For other k values, for example for k=−1 (black), the segments are separated from each other and show a depiction of the split initial curve.

In the exemplary embodiment, the orientation parameter k progresses within each of the movement segments 22 alternatingly either from −1 to +1 or from +1 to −1. For example, the orientation parameter in the movement segment 22A progresses from the lower to the upper edge from −1 to +1, while in the adjacent movement segment 22B, it progresses from the lower to the upper edge from +1 to −1. As shown in FIG. 8, said alternating progression continues along the entire curve depiction.

In the realization of the optically effective elements by the facets 30, the inclination angle of the facets in the y-direction was obtained through the relationship $$\alpha(k)=k\cdot 20°,-1\leq k\leq 1 \quad \text{(F1)}$$

from the orientation parameter k. If k varies between −1 and +1, then the inclination angle $\alpha$ changes accordingly between −20° (downward inclination) and +20° (upward inclination).

Through a two-dimensional specification of the orientation parameter k as in FIG. 8 and a relationship between the orientation parameter k and the inclination angles of the facets 30, such as relationship (F1), the facets of an areal motif region can be unambiguously described for a specified size of the facets. A corresponding reflective surface region 20 can then be produced, for example, through embossing of the facets thus described in an embossing lacquer layer and subsequent metalization in a per se known manner.

Coming back to the depiction in FIG. 2, the views in FIG. 2 show, expressed by the orientation parameter kin sequence from (a) to (e), the appearance for k=−1, k=−0.5, k=0 (initial curves), k=+0.5 and k=+1. In the realization of a k value specification by reflective facets, it must also be taken into account that the facets do not, in practice, reflect in an arbitrarily acute angle range but rather, depending on the design and the ambient light conditions, in an angle range of a few degrees. If, for example, the facets 30 light up in an angle range of 5°, then said angle range, together with the angular spread of the movement region, defines a line width under which the initial curve and the splitting segments appear. With the indicated values, a line width of, for example, $$s=5°/(2\times 20°)=1/8$$

of the size of the movement segments results.

The k values for a desired motif can be specified via suitable mathematical algorithms, the k value, for example, can increase in proportion to the distance of the segments from the initial curve. Alternatively, the values can also be produced by hand by a designer, for instance as a color gradient in a design sheet. The value of the orientation parameter preferably increases in proportion to the distance of a segment from the initial curve to the edge of the movement region to +1 or decreases to −1, as shown, for instance, in the exemplary embodiment in FIG. 8.

In principle, the connection between the orientation parameter and the distance from the initial curve can, of course, also be non-linear. As a result, especially the line width or the movement dynamics can be varied dependent on the tilt angle. For example, the k values around the k value of the initial curve can vary very strongly such that a sharp depiction of the initial curve is achieved. Toward the edge of the movement segments, the k value can then vary more slowly, causing the line width to become larger and the dynamic to increase.

In some embodiments, it can also be provided that the k value does not progress through the entire range between −1 and +1 in all segments. If the k value in one segment progresses, for example, only up to a k value of +0.5, then the segment appears, when tilted in viewing angles that correspond to k values above 0.5, to disappear, since then no optically effective elements are present that direct incident light toward the viewer at these viewing angles.

For the above-indicated relationship (F1) between the inclination angles of reflective facets and the orientation parameter k, the facets can, of course, also be chosen to be steeper or flatter, or be inclined, alternatively or additionally, in the x-direction instead of in the y-direction. What is essential is merely that, when tilted about a specified tilt axis, the optically effective elements having k=−1 to k=+1 are visible in sequence, for example become light, dark or colored and not visible again, such that a corresponding movement effect results for the segments.

If small hologram grating regions are used as optically effective elements, the orientation parameter k can be linked, for example, with the azimuth angle φ and/or the grating period p of the hologram grating regions, for example in the form $$\varphi(k)=k\cdot 30°,-1\leq k\leq 1 \quad \text{(F2)}$$

for azimuth angles between +30° and −30° or $$p(k)=1000\text{ nm}+k\cdot 500\text{ nm},-1\leq k\leq 1 \quad \text{(F3)}$$

for grating periods between 500 nm and 1.5 μm.

In further embodiments, as optically effective elements, also microrelief patterns having groove- and/or rib-shaped structural elements can be used, as are described, for example, in document WO 2014/117938 A1, whose disclosure is incorporated in the present application by reference. In this case, the orientation parameter k can be linked, for example, with the azimuth angle of the structural elements.

It is understood that, besides reflective facets, hologram gratings and microrelief patterns, also other optically effective elements can be used. Within the scope of the present invention, it is important only that, when tilted, the described moving segments appear to a viewer, regardless of whether said segments are light, dark, colored or visible in another manner, and whether this occurs in top view or when looked through.

Thus, according to a further design possibility, as optically effective elements, also microlens or concave microreflector grids can be used that, together with line patterns, effect moiré magnification effects. For this, the line patterns have approximately the same period as the microlens or concave microreflector grids and are arranged, for instance, in the focus plane of the microlenses or concave microreflectors. The microlenses or concave microreflectors direct incident light viewing-angle-dependently in a direction onto or next to the lines such that they appear to a viewer either in the color of the lines or in the color of the gaps. In this case, the orientation parameter k indicates how far the line pattern is shifted locally compared with the grid of the microlenses or concave microreflectors. For example, the center point of the lines of the line grid can, for a k value of −1, lie at a first edge of the individual microlenses or concave microreflectors, and for a k value of +1, at a second edge, opposite the first edge, of the microlenses or concave microreflectors.

The described movement effects can be produced, not only in top view, but also for viewing when looked through, both with facets and with hologram gratings and microrelief patterns. If the facets are not, for example, embedded in a material having the same or a very similar refractive index, then they act, when looked through, as small prisms, such that brightness differences in the transmitted light result and a movement effect according to the present invention can be produced in transmitted light.

In particular, with a thin semitransparent coating, for example a thin metal layer, it can be achieved that the same embossing patterns, as reflective facets, produce, in top view, a movement effect according to the present invention and, simultaneously, with the effect of microprisms, when looked through, additionally a movement effect according to the present invention. In a similar manner, also the above-mentioned microrelief patterns and hologram gratings can, for looking through, be coated for example semitransparently, for instance with a very thin metal layer, or high-index transparently.

The described concept is particularly advantageously used in so-called RollingStar® security threads or LEAD strips having micromirrors, that is, in designs having facets or micromirrors that are embossed with embossing heights of a maximum of 5 μm in an embossing lacquer and then metalized.

The metalization is advantageously done with a thin metal film or a color-shifting thin-film coating having the layer sequence reflector/dielectric/absorber.

FIGS. 9 and 10 illustrate a further exemplary embodiment of the present invention in which multiple curve depictions are visible from different viewing directions as initial curves having connected line segments. Specifically, the security element in the exemplary embodiment displays a metallic appearance in which, from a first viewing direction, the value numeral "50", and from a second viewing direction, the letter string "PL" are visible multiply one on top of another.

FIGS. 9(*a*) to (*i*) illustrate in greater detail, at different tilt angles, the visual appearance of a section of an areal motif region 50 that displays, as a motif, on one hand, the splitting value numeral "50", and on the other hand, the splitting letter string "PL". FIG. 10 shows the values of the orientation parameter k for this exemplary embodiment in a grayscale depiction 60.

Also in this exemplary embodiment, the depiction of the value numeral "50" includes the curve depictions 14A, 14B, already described in detail above, in the form of the numbers "5" and "0". The depiction of the letter string "PL" includes the curve depictions 54A, 54B in the form of the letters "P" and "L". Since the initial curves in this exemplary embodiment are not intended to be visible from the same viewing directions, but rather from different ones, the initial curves are associated with different values of the orientation parameter k. Specifically, the initial curves of the value numeral "50" correspond to a k value of +0.5 and the initial curves of the lettering "PL" correspond to a k value of −0.5. Furthermore, the movement segments 22 of the segments 18 of the value numeral "50" include only k values between 0 and 1, while the movement segments 52 of the segments 58 of the letter string "PL" include only k values between 1 and 0, as illustrated in FIG. 10.

When the motif region 50 is tilted, the appearances shown in FIG. 9 then result in sequence, which correspond to values of k=−1 (FIG. 9(*a*)), k=−0.75 (FIG. 9(*b*)), k=−0.5 (FIG. 9(*c*): letter string "PL" visible connected), k=−0.25 (FIG. 9(*d*)), k=0 (FIG. 9(*e*): offset segments of both depictions visible simultaneously), k=+0.25 (FIG. 9(*f*)), k=+0.5 (FIG. 9(*g*): value numeral "50" visible connected), k=+0.75 (FIG. 9(*h*)), up to k=+1 (FIG. 9*i*)).

The segments 18 of the value numeral "50" are visible only when tilted downward, since the associated movement segments 22 include no k values greater than 0. Similarly, the segments 58 of the letter string "PL" are visible only when tilted upward, since the associated movement segments 52 include no k values less than 0. Overall, when the motif region is tilted from bottom to top, from initially unordered segments 58 is created the letter string "PL" that, when tilted further, splits again, while from other unordered segments 22, the value numeral "50" is created that, for its part, splits when tilted further upward (FIGS. 9(*a*) to (*i*)). When tilted back, an inverse motion sequence appears.

Such a movement effect is very memorable and dynamic, and stands out clearly from known tilt effects. A further distinctive feature compared with conventional tilt effects consists in that, besides the connected depictions of the value numeral "50" and the letter string "PL" in certain viewing directions, also in the viewing directions lying therebetween, high-contrast dynamic depictions are visible that, however, do not or hardly permit the original depictions to be perceived any longer, but rather display a chaotic pattern of unordered segments (such as FIG. 9(*b*) or 9(*f*)). In particular, in the intermediate state at a value of k=0, no superimposition of the initial curves of the value numeral "50" and the letter string "PL" is visible, but rather an entirely different arrangement of segments 18 and 58 imaged in sharp focus.

In such depictions, the movement segments 22, 52 and the segments 18, 58 of the two sub-depictions are particularly advantageously coordinated with each other in such a way that individual segments continuously proceed from movement segments of the first depiction to movement segments of the second depiction. The aggregate depiction then includes a shared movement region in which one or more segments move in such a way that, from the first viewing directions, they are part of the first depiction, and from the second viewing directions, part of the second depiction. In this way, the visual impression can be produced that segments of the splitting first depiction reassemble to form the new second depiction.

In the exemplary embodiment in FIGS. 9 and 10, such a progression is realized for the movement segments 52C (upper left end of the letter "P") and 22C (lower left end of the number "5"). The region in FIG. 10 outlined with dotted lines thus represents a combined movement segment 56 having k values from −1 to +1, in which a segment 58C of the letter "P" proceeds upward when tilted (FIGS. 9(*c*) and 9(*d*)) and becomes a segment 18C of the number "50", as shown in FIGS. 9(*f*) and 9(*g*). FIG. 9(*e*) shows the intermediate state at k=0, in which both segments 18C, 58C are visible simultaneously.

The more segments are both part of the first and part of the second depiction, the more likely the impression will be created that the second depiction is recomposed of parts of the splitting first depiction.

LIST OF REFERENCE SIGNS

10 Banknote
12 Security element
14A, 14B Curve depictions
16A, 16B Tilt directions
18, 18C Segments
20 Areal motif region
22, 22A, 22B, 22C Movement segments
24-O, 24-U Edges of the movement segment 22A
26-O, 26-U Edges of the movement segment 22B
30, 32, 34, 36 Facets
40 Grayscale depiction
50 Areal motif region
52, 52C Movement segments
54A, 54B Curve depictions
56 Combined movement segment
58, 58C Segments
60 Grayscale depiction

The invention claimed is:

1. An optically variable security element for securing valuable articles that viewing-angle-dependently displays a motif having at least one curve depiction that, from a first viewing direction, is visible as an initial curve having two or more connected, non-collinear segments, and that, when the security element is tilted about a predetermined axis, splits into individual segments in that the segments of the initial curve move alternatingly in different directions away from the initial curve, having an areal motif region having a plurality of optically effective elements, each of which directs incident light in a preferred direction, the segments of the initial curve in the areal motif region each having associated with it one movement segment in the form of a sub-region of the areal motif region, in which sub-region the optically effective elements are arranged and aligned in such a way that, from the first viewing direction, they display the initial curve having the connected segments and that, from viewing directions tilted about the predetermined axis, they display curve depictions in which, with increasing tilt angle, the segments lie alternatingly in different directions increasingly further away from the initial curve.

2. The security element according to claim 1, wherein at least one curve depiction splits into three or more segments when the security element is tilted.

3. The security element according to claim 1, wherein the initial curve of at least one curve depiction displays an alphanumeric character, a symbol or another information-bearing character.

4. The security element according to claim 1, wherein the movement segments of the curve depictions have a width that is between 10% and 100% of the dimension of the initial curve of the curve depiction.

5. The security element according to claim 1, wherein the movement segments of at least one curve depiction all have the same width.

6. The security element according to claim 1, wherein the optically effective elements are formed by ray-optically effective facets whose orientation is characterized in each case by an inclination angle $\alpha$ against the plane of the areal motif region and by an azimuth angle $\theta$ in the plane of the areal motif region.

7. The security element according to claim 1, wherein the optically effective elements are formed by diffraction-optically effective grating fields having a grating pattern composed of parallel grating lines.

8. The security element according to claim 1, wherein the optically effective elements are formed by groove- and/or rib-shaped structural elements that lie adjacent to one another and extend along a longitudinal direction.

9. The security element according to claim 1, wherein the areal motif region is developed to be reflective such that the initial curve and the split of the initial curve into individual segments are visible in reflection.

10. The security element according to claim 1, wherein the optically effective elements are formed by reflection elements that are cast in an embossing lacquer and provided with a reflection-increasing coating.

11. The security element according to claim 10, wherein the reflection-increasing coating has a color-shift effect, especially in that the coating consists of a thin-film interference layer system having a reflector, a dielectric spacing layer and an absorber.

12. The security element according to claim 1, wherein the areal motif region is at least partially transmissive such that the initial curve and the split of the initial curve into individual segments are visible in transmission.

13. The security element according to claim 1, wherein the optically effective elements are formed by transmission elements in the form of transparent or semitransparent diffraction patterns, transparent or semitransparent prism patterns or transparent or semitransparent microrelief patterns.

14. The security element according to claim 1, wherein the motif includes at least a second curve depiction that, from a second viewing direction, is visible as a second initial curve having two or more connected, non-collinear segments, and that, when the security element is tilted about the predetermined axis, splits into the individual segments in that the segments of the second initial curve move alternatingly in different directions away from the second initial curve, the segments of the second initial curve in the areal motif region each having associated with it one second movement segment in the form of a sub-region of the areal motif region, in which sub-region the optically effective elements are arranged and aligned in such a way that, from the second viewing direction, they display the second initial curve having the connected segments and that, from viewing directions tilted about the predetermined axis, they display curve depictions in which, with increasing tilt angle, the segments lie alternatingly in different directions increasingly further away from the second initial curve.

15. The security element according to claim 14, wherein the movement segments of the first and second curve depiction do not overlap.

16. The security element according to claim 14, wherein the first and second viewing direction include an angle of at least 5°.

17. The security element according to claim 14, wherein at least one segment of the first curve depiction is also a segment of the second curve depiction such that, when the security element is tilted, the second curve depiction is at least partially composed of segments of the split first curve depiction.

18. The security element according to claim 1, wherein the security element is a security thread, a tear strip, a security band, a security strip, a patch or a label for application to a security paper, value document or the like.

19. A data carrier having a security element according to claim 1.

20. A method for manufacturing an optically variable security element according to claim 1, in which a desired initial curve having two or more connected, non-collinear segments is defined, for each of the segments of the initial curve, movement segments are defined in which the segments of the initial curve move when the security element is tilted, and in an areal motif region in the defined movement segments, optically effective elements are arranged and aligned in such a way that, from the first viewing direction, they display the initial curve having the connected segments and that, from viewing directions tilted about the predetermined axis, they display curve depictions in which, with increasing tilt angle, the segments lie alternatingly in different directions increasingly further away from the initial curve.

* * * * *